US007007521B1

(12) United States Patent
Misner et al.

(10) Patent No.: US 7,007,521 B1
(45) **Date of Patent: *Mar. 7, 2006**

(54) COMBINATION AND KEY OPERATED PADLOCK WITH INDICATOR

(75) Inventors: Michael O. Misner, Lake Villa, IL (US); Jian-Bing Lu, Shanghai (CN)

(73) Assignee: The Eastern Company, Wheeling, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/098,205

(22) Filed: Apr. 4, 2005

Related U.S. Application Data

(63) Continuation of application No. 10/634,201, filed on Aug. 5, 2003.

(51) Int. Cl.
*E05B 37/06* (2006.01)

(52) U.S. Cl. ..... 70/21; 70/25; 70/432; 70/435; 70/437

(58) Field of Classification Search ..... 70/25–29, 70/432, 435, 437, 439, 441, 52–56, 21
See application file for complete search history.

(56) References Cited

U.S. PATENT DOCUMENTS

| | | | | |
|---|---|---|---|---|
| 771,092 | A | 9/1904 | Raney | 70/435 |
| 941,028 | A | 11/1909 | Murphy | 70/285 |
| 972,171 | A | 10/1910 | Dupont | 70/21 |
| 1,755,521 | A | 4/1930 | Smith | 70/21 |
| 1,937,523 | A | 12/1933 | Machinist | 70/53 |
| 1,981,163 | A | 11/1934 | Carlson | 70/53 |
| 2,049,416 | A | 8/1936 | Aldeen | 70/113 |
| 2,163,852 | A | 6/1939 | Pond | 70/21 |
| 2,315,102 | A | 3/1943 | Admas | 70/432 |
| 2,487,608 | A | 11/1949 | Soref et al. | 70/21 |
| 2,546,182 | A | 3/1951 | Fenari | 70/312 |
| 2,725,739 | A | 12/1955 | Check | 70/285 |
| 2,839,322 | A | 6/1958 | Kirk | 292/251 |
| 2,923,928 | A | 2/1960 | McLaughlin | 340/27 A |
| 2,926,514 | A | 3/1960 | Junkune | 70/21 |
| 2,931,203 | A | 4/1960 | Check | 70/21 |
| 2,931,204 | A | 4/1960 | Check | 70/21 |
| 2,995,025 | A | 8/1961 | Toepfer | 70/58 |
| 3,009,345 | A | 11/1961 | Check | 70/21 |
| 3,050,977 | A | 8/1962 | Foote et al. | 70/332 |
| 3,349,584 | A | 10/1967 | Russell et al. | 70/21 |
| 3,472,049 | A | 10/1969 | Sewell | 70/21 |
| 3,720,082 | A | 3/1973 | Feinberg et al. | 70/25 |
| 3,750,431 | A | 8/1973 | Atkinson | 70/21 |
| 3,823,584 | A | 7/1974 | Gill | 70/21 |
| 3,894,415 | A | 7/1975 | Bako | 70/21 |
| 4,055,972 | A | 11/1977 | Calegan | 70/21 |
| 4,170,884 | A | 10/1979 | Calegan | 70/21 |
| 4,325,240 | A | 4/1982 | Gable | 70/284 |

(Continued)

OTHER PUBLICATIONS

Prestolock By CCL Security Products, New Britan, CT 06051 2-Page Brochure #PL994-01, Believed To Date Back To 1994.

(Continued)

*Primary Examiner*—Suzanne Dino Barrett
(74) *Attorney, Agent, or Firm*—David A. Burge

(57) ABSTRACT

A padlock for luggage that can be operated by setting a combination or by inserting and turning a key is provided with an indicator that normally displays a first state when the lock being used in a normal way as a combination operated padlock, but which displays a second state if the padlock has been opened by utilizing a key.

33 Claims, 12 Drawing Sheets

U.S. PATENT DOCUMENTS

| | | | | | |
|---|---|---|---|---|---|
| 4,444,029 | A | | 4/1984 | Remington | 70/25 |
| 4,453,390 | A | | 6/1984 | Moritz et al. | 70/434 |
| 4,462,231 | A | | 7/1984 | Zabel | 70/21 |
| 4,490,999 | A | | 1/1985 | Castle et al. | 70/432 |
| 4,559,796 | A | | 12/1985 | De Forrest, Sr. | 70/432 |
| 4,583,775 | A | | 4/1986 | Bisbing | 292/64 |
| 4,651,544 | A | * | 3/1987 | Hungerford | 70/63 |
| 4,730,467 | A | | 3/1988 | Lebrecht | 70/25 |
| 4,733,548 | A | | 3/1988 | Ling | 70/25 |
| 4,829,794 | A | | 5/1989 | Crown | 70/25 |
| 4,829,795 | A | | 5/1989 | Taylor | 70/54 |
| 4,914,732 | A | * | 4/1990 | Henderson et al. | 340/3.71 |
| D321,824 | S | | 11/1991 | Appelbaum | D6/334 |
| 5,125,248 | A | | 6/1992 | Ling | 70/25 |
| D331,908 | S | | 12/1992 | Hollander et al. | D13/133 |
| 5,408,212 | A | | 4/1995 | Meyers et al. | 340/427 |
| 5,460,020 | A | * | 10/1995 | Hungerford | 70/63 |
| 5,520,032 | A | | 5/1996 | Ling | 70/25 |
| D372,187 | S | | 7/1996 | Ling | D8/334 |
| 5,588,877 | A | | 12/1996 | Davis et al. | 439/660 |
| 5,791,172 | A | * | 8/1998 | Deighton et al. | 70/63 |
| 5,794,466 | A | * | 8/1998 | Hungerford et al. | 70/63 |
| D400,170 | S | | 10/1998 | Asai et al. | D13/133 |
| D406,522 | S | | 3/1999 | Ling | D8/334 |
| 5,881,582 | A | | 3/1999 | Monaco | 70/14 |
| 5,911,764 | A | | 6/1999 | Wei Kong | 70/160 |
| 6,035,672 | A | | 3/2000 | Lai | 70/25 |
| 6,047,575 | A | | 4/2000 | Larson et al. | 70/278 |
| 6,047,577 | A | | 4/2000 | Klimas | 70/340 |
| D424,016 | S | | 5/2000 | Gipson et al. | D13/133 |
| 6,070,442 | A | * | 6/2000 | Neeley et al. | 70/175 |
| 6,146,181 | A | | 11/2000 | Plaza | 439/357 |
| D434,966 | S | | 12/2000 | Ling | D8/334 |
| D444,768 | S | | 7/2001 | Kishi | D13/133 |
| D450,232 | S | | 11/2001 | Taylor et al. | D8/335 |
| D451,002 | S | | 11/2001 | Lai | D8/334 |
| 6,315,485 | B1 | | 11/2001 | Speck et al. | 403/7 |
| 6,474,116 | B1 | | 11/2002 | Lai | 70/25 |
| 6,516,643 | B1 | | 2/2003 | Olshausen | 70/337 |
| D471,872 | S | | 3/2003 | Kawase | D13/147 |
| D472,877 | S | | 4/2003 | Jaag | D13/133 |
| 6,539,761 | B1 | | 4/2003 | Yang | 70/284 |
| 6,553,795 | B1 | * | 4/2003 | Trempala | 70/167 |
| D474,674 | S | | 5/2003 | Ling | D8/343 |
| 6,575,005 | B1 | * | 6/2003 | Hunter | 70/432 |
| D486,720 | S | | 2/2004 | Ling | D8/334 |
| 6,708,532 | B1 | | 3/2004 | Winland | 70/2 |
| 6,708,534 | B1 | | 3/2004 | Ruan | 70/38 |
| 6,761,051 | B1 | * | 7/2004 | Tsai | 70/38 B |
| 6,851,213 | B1 | * | 2/2005 | Doiron | 42/70.11 |
| 6,860,125 | B1 | | 3/2005 | Yu | 70/25 |
| 6,877,345 | B1 | * | 4/2005 | Misner et al. | 70/25 |
| 6,880,370 | B1 | | 4/2005 | Yu | 70/25 |
| 6,904,776 | B1 | | 6/2005 | Lin | 70/25 |
| 2002/0088256 | A1 | | 7/2002 | Taylor et al. | 70/38 |

OTHER PUBLICATIONS

Lock In Loyalty, Prestolock Keyless Security, New Britain, CT 06051 2 -Page Brochure Depicting No. 2430 & No. 2400 Padlocks, Believed To Date 1994.

Japan Application No. Showa 5 No. 11247 Dated Apr. 19, 1931 Disclosure Dated Mar. 31, 1932 Inventor & Applicant: Unpei Oka Disclosure Gazette No. 3441 Entitled: Padlock (Accompanied By 3-Page English Translation.

* cited by examiner

COMBINATION AND KEY OPERATED PADLOCK WITH INDICATOR

REFERENCE TO RELATED APPLICATION

The present application is a continuation of application Ser. No. 10/634,201 filed Aug. 5, 2003 by Michael O. Misner and Jian-Bing Lu entitled Combination and Key Operated Padlock With Indicator.

BACKGROUND OF THE INVENTION

The present invention relates to combination operated padlocks of the type typically used to secure luggage during travel and transport. More particularly, the present invention relates to combination operated luggage padlocks that also may be operated by a key to facilitate inspection of the contents of luggage. Specifically, the present invention relates to providing combination and key operated luggage padlocks and the like with a resettable indicator to advise the owners of luggage that the locks on their bags have been opened by means of a key for inspection—an indicator that preferably can be reset only by the owners after they have opened the locks by entering their combinations.

When the Transportation Security Administration took over the handling of airport security in accordance with the Homeland Security Act, the intensified effort made by federal employees to inspect the locked bags of airline passengers often resulted in the destruction of luggage padlocks when the shackles thereof were severed to permit inspection of luggage contents. The destruction of luggage padlocks unfortunately leaves inspected bags unlocked, with their contents subject to pilfer and theft during travel and transport.

To accommodate the need of travelers for post-inspection luggage security while also accommodating the need of government employees to quickly and easily open and inspect selected and suspect bags, a proposal has been advanced by an entity known as Travel Sentry for providing government personnel with "override keys" for nondestructively opening consumer owned, combination operated luggage padlocks that have built-in "key override" features. In accordance with the proposal of Travel Sentry, combination operated luggage padlocks having a "key override" capability are to be made by a number of padlock manufacturers. These padlocks may be purchased by consumers for locking their luggage; and, if their locked bags are inspected by government personnel, the padlocks will be opened for baggage inspection using keys that are made available to government inspectors (but not to the owners of the padlocks), and then will be relocked by the inspectors. Bags inspected and relocked in this manner will have their contents secured by the same combination operated padlocks that were installed on the bags by the owners thereof.

Padlocks that can be operated by combination and by key are not new. Combination padlocks have been used for many years on gym lockers in schools, with coaches and principals having keys that can open these padlocks should lockers need to be inspected, or should a padlock be snapped closed on an incorrect locker by mistake or by prank. It also is known to provide combination padlocks with keys so that their owners may elect whether to open the locks by entry of a combination, or by using a key.

It is not completely new to provide a padlocks with some form of indicator. For example, padlocks (that are not of the type that can be opened both by combination and by key) have been provided with indicators that are intended to prevent accidental resettings of the combinations of the locks, or that are intended to reflect when the padlocks are incompletely or improperly relocked after being opened. However, prior proposals relating to padlocks of the type that can be opened by combination or by key have not taught or suggested the provision of indicators designed to advise the owners of the locks that the luggage on which the padlocks are installed has been inspected by opening the padlocks with a key.

SUMMARY OF THE INVENTION

The present invention relates to improvements in key and combination operated padlocks, namely to providing such locks with indicators that reflect whether government inspectors have used an override key to unlock and inspect the contents of luggage that is locked by these locks.

In preferred practice, the housing of a combination and key operated luggage padlock is provided with an indicator that normally displays a first state, such as the color "green," when the lock has been installed on luggage by the owner for travel and transport, and that displays a second state, such as the color "red," once the lock has been opened by using a key to inspect luggage contents. The second state continues to be displayed until the indicator is deliberately reset by the owner after the owner opens the lock using a combination known to the owner, not to the inspectors. A safeguard of the preferred practice of the present invention resides in the provision of an indicator reset mechanism that prevents the indicator from being reset while the padlock is unlocked after being opened by means of a key: therefore, government inspectors are prevented from resetting the lock's indicator.

In preferred practice, the housing-carried indicator takes the form of a window opening formed through a front wall of the housing, and an indicator carried within the interior of the housing that is movable between first and second positions wherein a first state surface or a second state surface the indicator are displayed through the window opening, with the first state surface being displayed when the indicator is in the first position, and with the second state surface of the indicator being displayed through the window opening when the indicator is in the second position.

In the most preferred practice of the invention, the housing-carried indicator 1) is protectively enclosed by the housing, 2) is pivotally supported by the housing for movement between a first state position and a second state position, 3) is biased by an over-center spring toward the first state position as the indicator nears the first state position and toward the second state position as the indicator nears the second state position so as to retain the indicator in one or the other of the first and second state positions unless deliberately moved from one of these positions to the other, 4) is configured to be moved from its normal first state position to its second state position in response to the turning of a correctly configured key that has been inserted through a keyhole of the housing to unlock the padlock, and 5) can only be reset (i.e., moved from the second state position back to the normal first state position) after padlock has been relocked (i.e., after the shackle has been closed and the key has been removed from the padlock) and after the padlock then has been reopened by setting a combination known to the owner. To reset the indicator, the owner of the padlock enters the correct combination to open the lock, and then manipulates the shackle in a specific way that causes the indicator to be reset.

BRIEF DESCRIPTION OF THE DRAWINGS

These and other features, and a fuller understanding of the invention may be had by referring to the following description and claims taken in conjunction with the accompanying drawings, wherein:

DESCRIPTION OF INVENTION EMBODIMENTS

Figure 1:
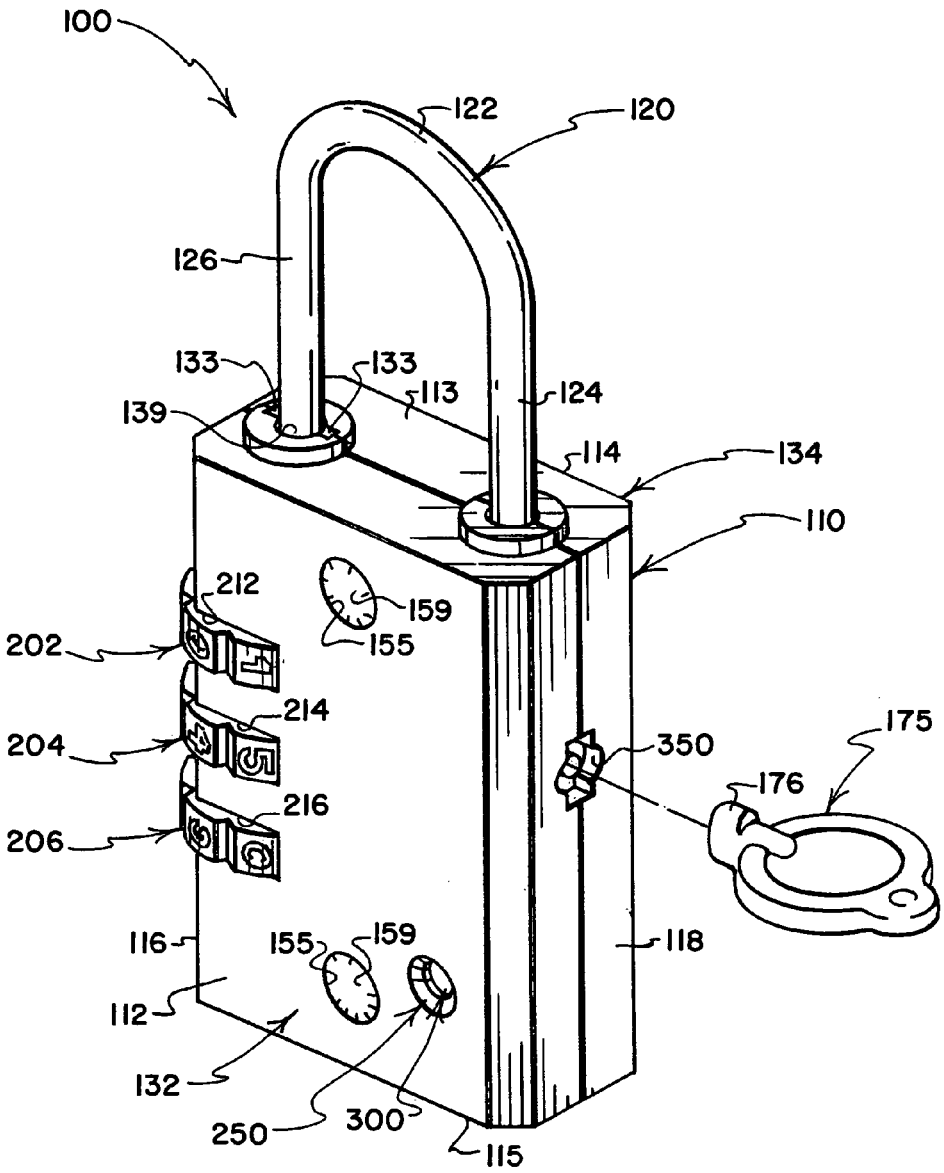
FIG. 1 is a perspective view showing a combination and key operated padlock having an indicator surface that is visible through an indicator window defined by a front wall of the padlock, with the shackle of the padlock in it locked position, and with a key positioned for insertion into a keyhole defined by a right side wall of the padlock.

Referring to FIG. 1, a padlock that may be operated either by entering a combination or by using a key 175 is indicated generally by the numeral 100. The padlock 100 has a housing 110 that, for purposes of illustration, takes a generally rectangular form; and a shackle 120 that, for purposes of illustration, takes a relatively short, generally U-shaped form. While the housing 110 is depicted as being of generally rectangular shape, and while the shackle 120 is depicted as being of relatively short, generally U-shaped configuration, those who are skilled in the art will readily understand that the housing need not take the relatively conventional, substantially rectangular shape that is shown, and that the shackle 120 may be substantially longer, or shorter, or may take other than a U-shaped configuration while still providing a padlock that incorporates the resettable indicator features of the present invention.

The housing 110 has opposed front and rear walls 112, 114; opposed top and bottom walls 113, 115; and opposed left and right side walls 116, 118. The shackle 120 has a U-shaped bend 122 that joins a relatively short leg 124 and a relatively long leg 126 that extends parallel to the shorter leg 124. The relatively longer nature of the leg 126 and the relatively shorter nature of the leg 124 of the shackle 120 is well illustrated in FIG. 2, where internal features of components of the padlock 100 also are shown.

Figure 2:
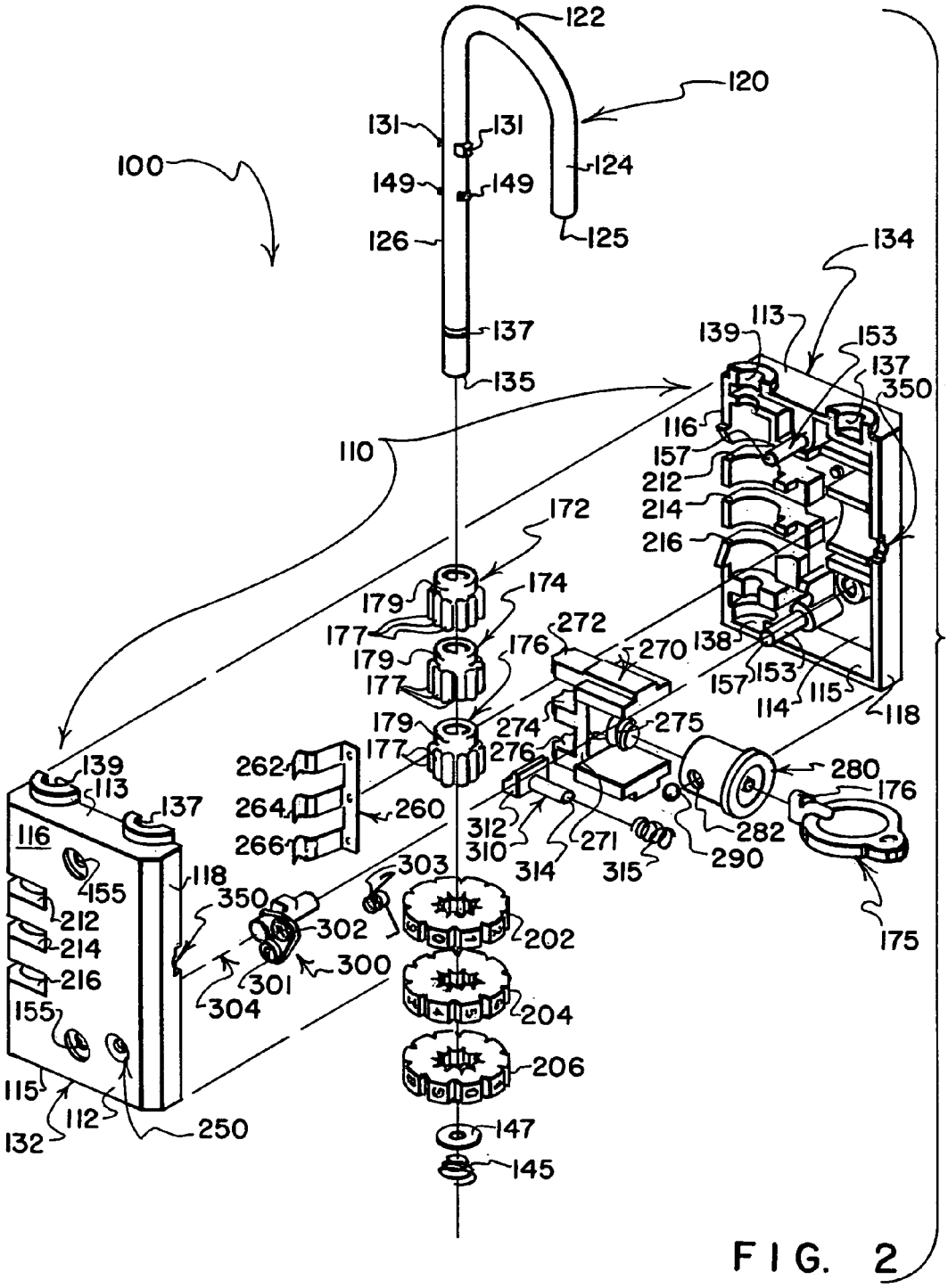
FIG. 2 is an exploded perspective view showing the two halves or shells of the housing separated, and showing internal components of the padlock, and the key.
Figure 3:
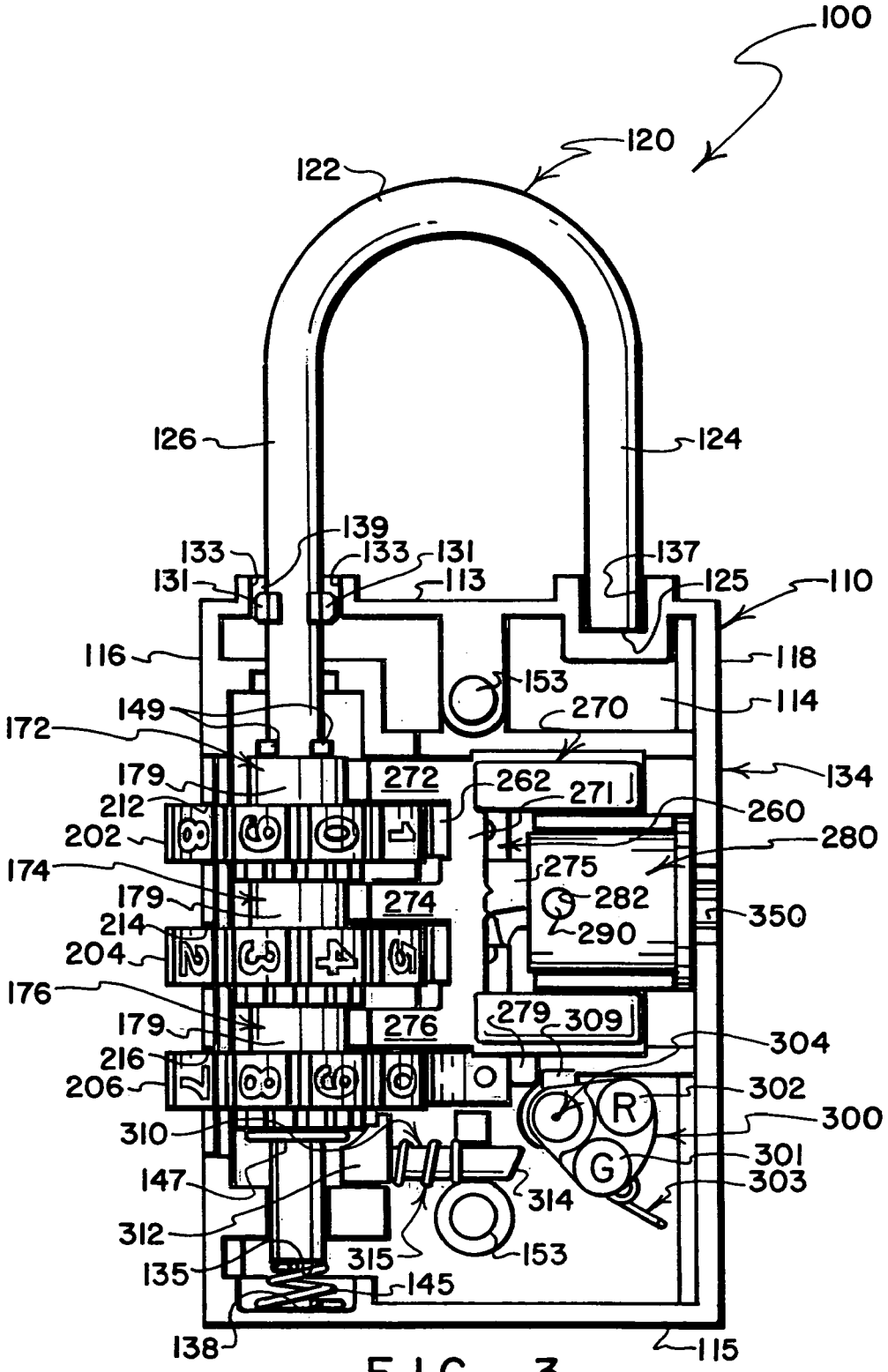
FIG. 3 is a front elevational view of components of the padlock with the front shell of the housing removed, with the shackle locked, and with the indicator positioned to display a first state, namely the color green.
Figure 5:
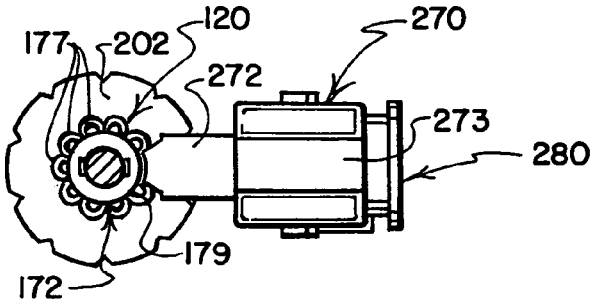
FIG. 5 is a sectional view as seen from a plane indicated by a line 5—5 in FIG. 4.
Figure 6:
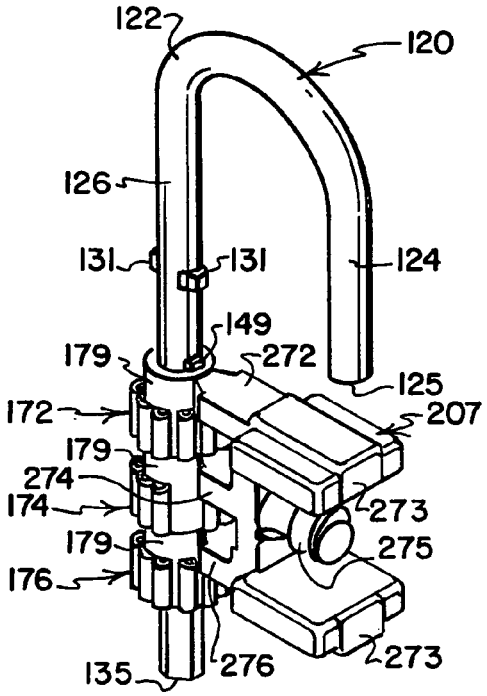
FIG. 6 is a perspective view of selected components of the padlock positioned as in FIGS. 3–5.
Figure 4:
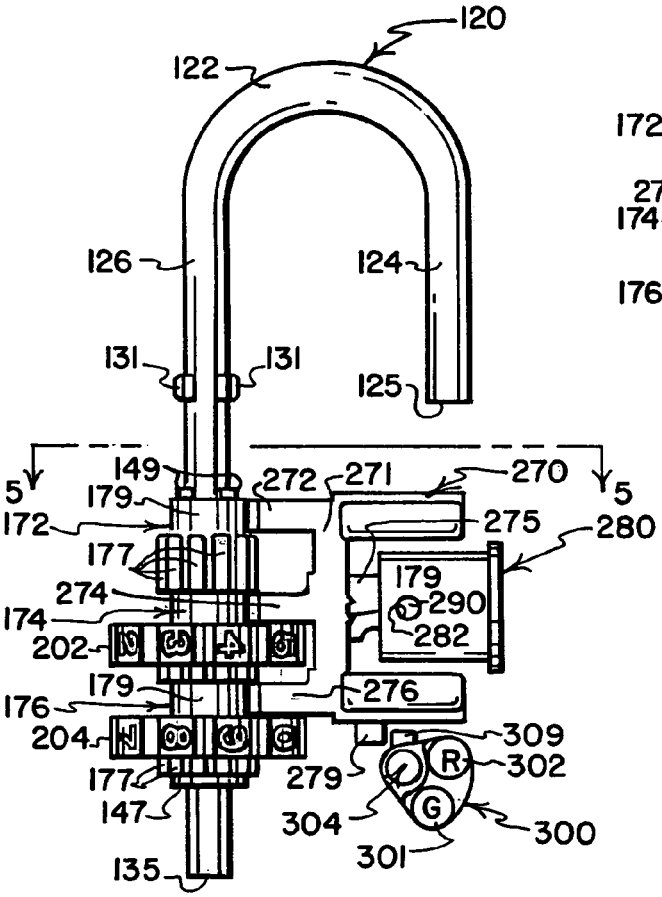
FIG. 4 is a front elevational view showing selected components of the padlock positioned as in FIG. 3.

Referring to FIGS. 2 and 3, the shorter leg 124 of the shackle 120 has a relatively flat bottom end region 125 that is configured to seat, when the padlock 100 is locked, within a shallow, upwardly facing recess 137 defined by the top wall 113 of the housing 110. The longer leg 126 of the shackle 120 extends through an opening 139 formed through the top wall 113 of the housing 110, and has a relatively flat bottom end region 135 that extends to a location relatively near, but spaced from, an inner surface portion 138 of the bottom wall 115 of the housing 110. A compression coil spring 145 is interposed between the bottom end region 135 of the longer leg 126 and the inner surface portion 138 of the bottom wall 115 of the housing so as to cause the shackle 120 to "pop up" (when the padlock is unlocked) to an unlocked position shown in FIG. 7 wherein the flat bottom end region 125 of the shorter leg 124 disengages the upwardly facing recess 137. When the shackle 120 has "popped up" from the locked position to the unlocked position of FIG. 3, the shackle 120 can be rotated about the axis of the longer leg 126 relative to the housing 110, for example to the half-turn unlocked position shown in FIG. 15.

Referring to FIGS. 1 and 2, externally viewable components of the padlock 100 include the front and rear shells 112, 114 of the housing; the U-shaped shackle 120; three identically configured, wheel-like dials 202, 204, 206 carried in spaced parallel-extending slots 212, 214, 216 that are defined by left side regions of the housing 110; a beveled indicator display window 250 formed through the front side wall 112 of the housing 110; and a keyhole 350 that extends through the right side wall 118 of the housing 110 at a location about mid-way along a vertical line of juncture of portions of the front and rear shells 132, 134 that cooperate to define the right side wall 118. The keyhole 350 is configured to receive an end region 176 of the key 175. After the end region 176 of the key 175 is inserted into the keyhole 350, the key 175 can be turned to unlock the shackle 120 of the padlock 100 for movement from the locked position of FIGS. 1 and 3 to the unlocked position of FIG. 7.

In preferred practice, the padlock 100 preferably is comprised of only about twenty separately formed parts. Referring principally to FIG. 2, these twenty parts include the front and rear shells 132, 134 of the housing 110; the shackle 120; the compression coil spring 145 that engages the lower end region of the longer leg 126 of the shackle 120 when the shackle 120 is locked, so as the bias the shackle 120 upwardly to "pop up" to an unlocked position whenever such movement is permitted by other components of the lock 100 either by setting a correct combination using the dials 202 or by inserting and turning the key 175; three identically configured sleeves 172, 174, 176 that have external teeth 177 that normally engage internal teeth 187 of the three identically configured dials 202, 204, 206; a leaf spring 260 which has three arms 262, 264, 266 that press against the peripheries of the dials 202, 204, 206 to assist in retaining the dials 202, 204, 206 in their current positions; a retaining washer or spring steel retaining clip 147 that resides in a groove 137 formed in the longer leg 126 of the shackle 120; a slide member 270 that has three leftwardly projecting fingers 272, 274, 276 configured to normally overlie at least some of the teeth 177 of the toothed sleeves 172, 174, 176, and to engage hub portions 179 of the sleeves 172, 174, 176 when the lock 100 is locked, with the slide member 270 also having a vertically extending formation 271 that interconnects the fingers 272, 274, 276 and a pair of vertically spaced slide portions 273 configured to engage suitably configured internal portions of the housing shells 132, 134 to enable the slide member 270 to slide leftward and rightly so the fingers 272, 274, 276 can move into and out of engagement with the smooth hub portions 179 of the externally toothed sleeves 172, 174, 176, and with the slide member 270 also having a centrally located formation that projects rightwardly from the vertically extending formation 271 to define a spiral groove or spirally grooved surface 275 (best seen in FIG. 12) that is surrounded by a hollow left portions of a cylinder 280 (as is best seen in FIG. 12); a steel ball 290 that is carried in a hole 282 formed through hollow left portions of the cylinder 280 (as is best seen in FIG. 12) and which drivingly engages the spirally grooved surface 275 of the slide 270 to establish a one-way driving connection between the cylinder 280 and the slide 270 that permits rotation of the cylinder 280 to move the slide 270 rightwardly and leftwardly relative to the housing 110 (between a normal position of the slide 270 shown in FIGS. 3–5, 7–10, 16 and 17, and a key-unlocked position of the slide 270 shown in FIGS. 11–14) as the ball 290 moves along the spirally grooved surface 275 of the slide 270, but which does not permit the slide 270 to move rightwardly and leftwardly on its own so as to cause rotation of the cylinder 280; a reset member 300 that is supported internally within the housing 110 for pivotal movement about an axis 304 between first state and second state positions wherein the indicator 300 presents one or the other of a first state surface 301 (which typically displays the color "green") and a second state surface 302 (which typically displays the color "red") to the indicator window 250 of the housing 110; a torsion spring 303 that is interposed between the housing 110 and the indicator 300 for biasing the indicator toward one or the other of its first state or second state positions; and, a reset member 310 that is supported internally within the housing 110 for leftward and rightwardly movement, and that is biased leftwardly by a compression coil spring 315.

Referring to FIG. 2, the front and rear housing shells 134, 134 are held together by pin-like projections 153 of the rear shell 134 that extend through holes 155 formed in the front shell 132. Outer end regions 157 of the pin-like projections 153 are riveted or clenched (as is indicated by the numerals 159 in FIG. 1) after the front and rear shells 132, 134 have been assembled with internal components of the padlock 100 protectively housed therebetween, to permanently clamp the front and rear housing shells 132, 134 together.

Interior features of the front housing shell 132 substantially mirror the interior features of the rear housing shell 134 that are depicted in FIGS. 2, 3, 7, 11 and 15–17, except for the pin-like projections 153 of the rear shell 134 that are received in the openings 155 of the front shell 132. Protectively enclosed within passages, chambers or compartments that are cooperatively defined by interior portions of the front and rear housing shells 132, 134 are the majority of the parts that comprise the padlock 100, several of which are movable relative to the housing 110 as described herein.

Figure 16:
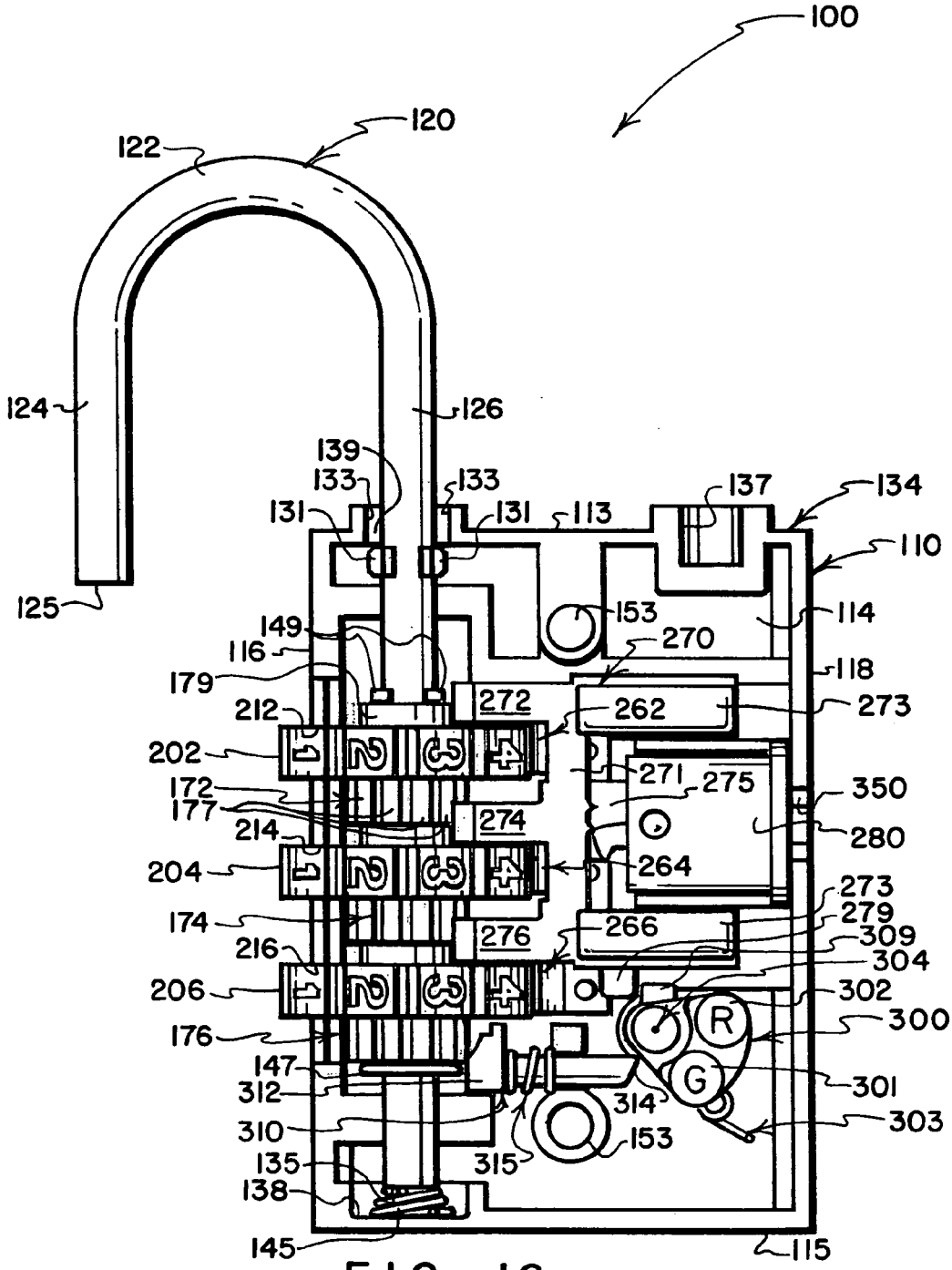
FIG. 16 is a front elevational view showing selected components of the padlock with the front shell of the housing removed, with the components as they appear near the completion of a shackle manipulation procedure that is employed by the owner of the padlock to reset the indicator, more specifically with the shackle depressed while in the half-turn orientation of FIG. 15, and with the indicator having been reset due to the depression of the shackle so as to display the first state (typically the color "green")
Figure 17:
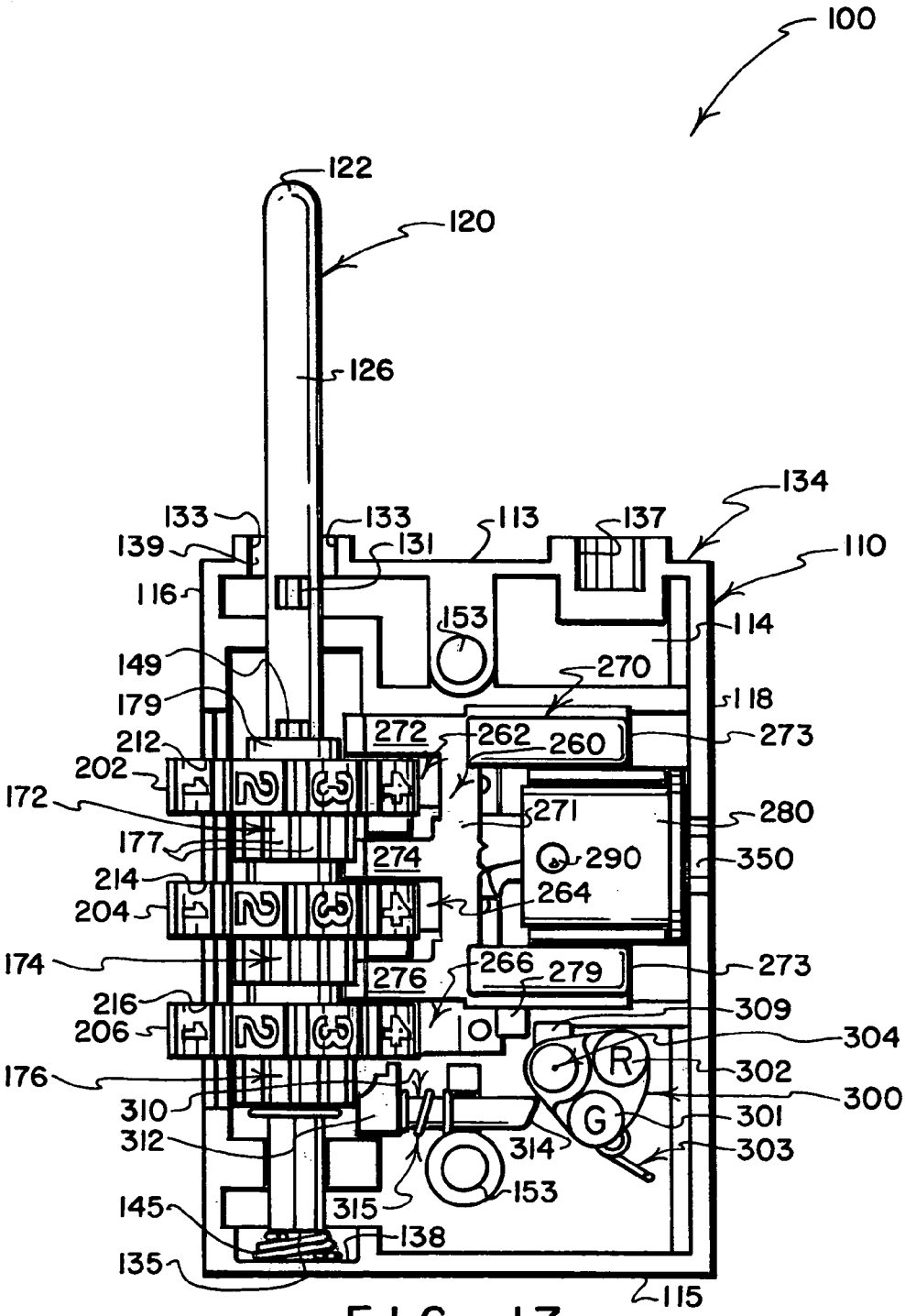
FIG. 17 is a front elevational view showing selected components of the padlock with the front shell of the housing removed, with the components as they are positioned for permitting the combination of the padlock to be changed, with the shackle having been turned a quarter turn after first having been turned to the half-turn position of FIG. 15 and after second having been depressed to the indicator reset position of FIG. 16.
Figure 18:
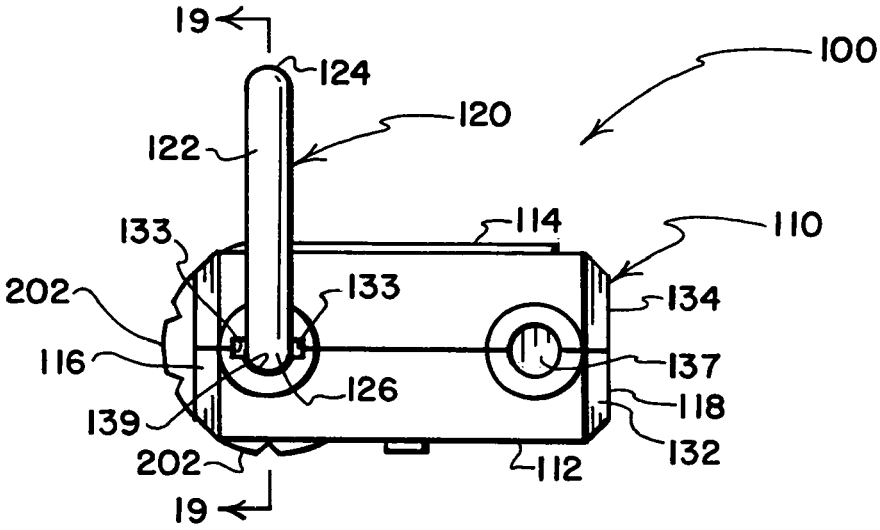
FIG. 18 is a top plan view of the padlock with the components thereof positioned as in FIG. 17; and, FIG. 19 is a cross-sectional view of selected components of the padlock as seen from a plane indicated by a line 19—19 in FIG. 18.
Figure 19:
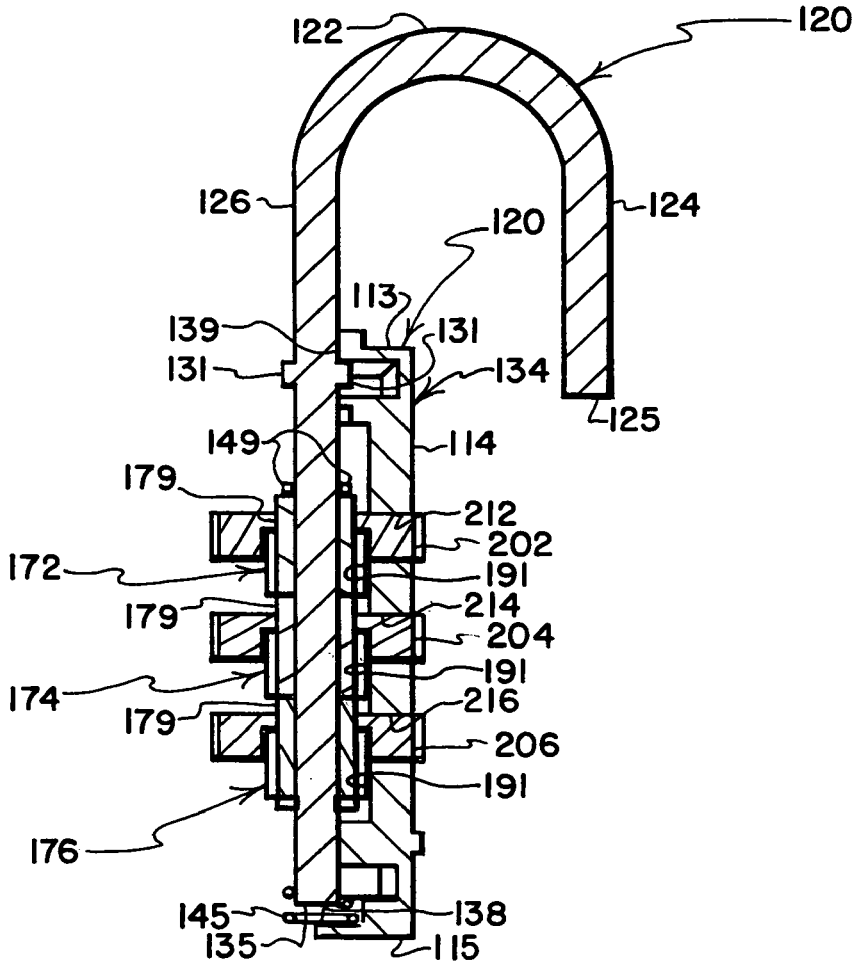

Except when the shackle 120 of the lock 100 is depressed for purposes either of resetting the indicator 300 of the lock 100, or resetting the combination of the lock 100, the teeth 187 of the internally toothed regions 203, 205, 207 of the dials 202, 204, 206 always drivingly engage the teeth 177 of the toothed sleeves 172, 174, 176. Disengagement of the teeth 187 from the teeth 177 occurs only when the longer leg 126 of the shackle 120 is depressed, as depicted in FIGS. 16, 17 and 19 sufficiently to 1) bring reduced diameter hub portions 179 of the sleeves 172, 174, 176 into a region surrounded by the internally projecting teeth 187 of the dials 202, 204, 206, and sufficiently to 2) bring enlarged, downwardly facing cavities 191 of the dials 202, 204, 206 into surrounding relationship with the radially outwardly projecting teeth 177 of the sleeves 172, 174, 176. Disengagement of the teeth 187 from the teeth 177 suspends the driving connection that normally exists between the dials 202, 204, 206 and the toothed sleeves 172, 174, 176. When the driving connection between the teeth 177, 187 is suspended, this permits the dials 202, 204, 206 to be rotated relative to the toothed sleeves 172, 174, 176 so that a new combination for operating the lock 100 can be set.

Figure 9:
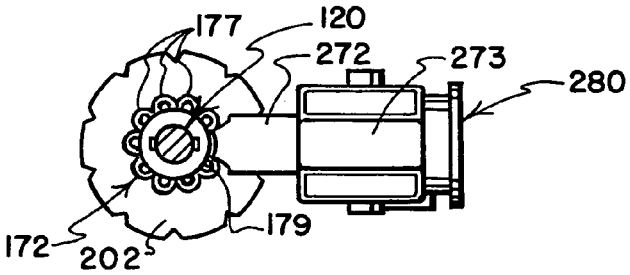
FIG. 9 is a sectional view as seen from a plane indicated by a line 9—9 in FIG. 8.

Each of the toothed sleeves 172, 174, 176 has positions for ten equally spaced teeth 177, but only nine of these ten positions carry tooth formations 177. The fingers 272, 274, 276 of the slide 270 are configured to normally overlie one or more of the teeth 177 of the externally toothed sleeves 172, 174, 176; however, when the dials 202, 204, 206 are turned to set a correct combination for unlocking the lock 100, the fingers 272, 274, 276 are aligned with the unoccupied tooth positions of the toothed sleeves 172, 174, 176 (as depicted in FIG. 9) which permits the shackle 120 (and the toothed sleeves 172, 174, 176 which are carried by the longer shackle leg 126 at a location between the retaining washer or clip 147 and a crimped region 149 of the shackle) to be raised so that the flat bottom end region 125 of the shorter leg 124 of the shackle 120 no longer resides in the housing recess 137 (which is where the bottom end region 125 resides when the shackle 120 is closed—i.e., when the lock 100 is locked).

The externally toothed sleeves 172, 174, 176 are journaled for rotation at spaced locations along the longer leg 126 of the U-shaped shackle 120. Also journaled for rotation at spaced locations along the longer leg 126 are the dials 202, 204, 206. While the toothed sleeves 172, 174, 176 move upwardly and downwardly as the longer leg 126 of the shackle 120 moves upwardly and downwardly to unlock and lock the lock 100, the dials 202, 204, 206 do not move upwardly and downwardly, for the dials project through the slots 212, 214, 216 of the housing 110 and therefore cannot move vertically with respect to the housing 110.

Figure 15:
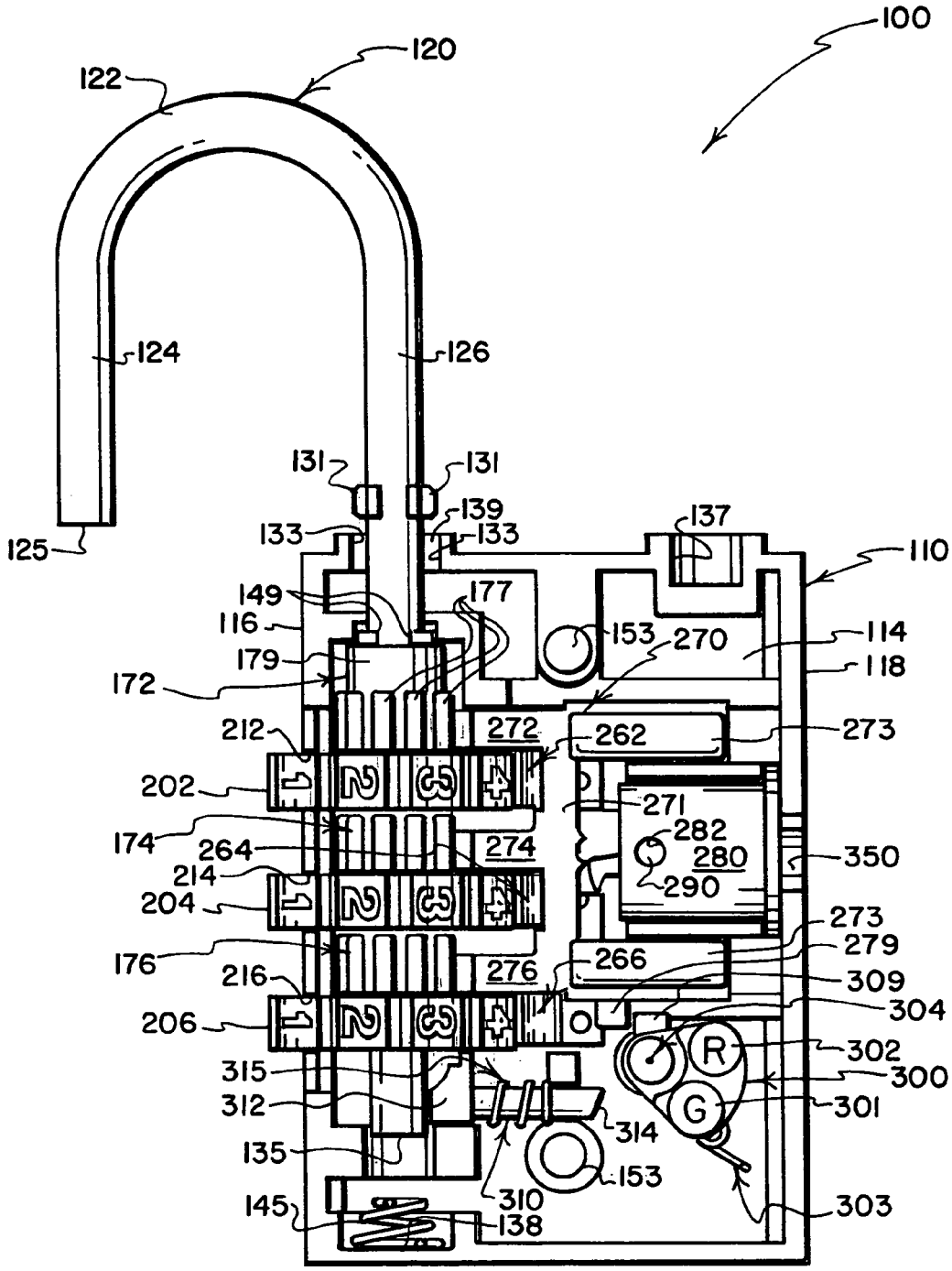
FIG. 15 is a front elevational view showing selected components of the padlock with the front shell of the housing removed, with the components as they appear mid-way through a shackle manipulation procedure that is employed by the owner of the padlock to reset the indicator from displaying the second state (typically the color 9"red") to displaying the first state (typically the color "green"), more specifically with the shackle having been unlocked (by entering a correct combination using the three dials of the padlock at a time after the indicator has been moved to display its second state color "red" as the result of the padlock's previously having been opened using a key), and with the shackle turned a half turn relative to the housing.

The longer leg 126 of the shackle 120 is crimped not only at a location (discussed previously and identified by the numeral 149) but also at a slightly higher location where opposed projections 131 are formed on the longer leg 126 by pinching or crimping the material of the longer leg 126. The opposed projections 131 align with widened portions 133 of a top wall opening 139 (of the housing 110 through which the longer leg 126 of the shackle 120 extends) when the shorter leg 124 of the shackle 120 is in either of two positions, namely 1) when the shorter leg 124 of the shackle 120 is aligned with the recess 137 (as depicted in FIGS. 3, 7 and 11, or 2) when shackle 120 is half-turned around (as depicted in FIGS. 15 and 16) such that the shorter leg 124 of the shackle 120 is as far away as it can get from the recess 137. At all other orientations of the shackle 120 relative to the housing 110, for example in the quarter-turned orientation depicted in FIG. 17) the opposed projections 131 are out of alignment with the widened portions 133 of the top wall opening 139.

The alignment and non-alignment of the projections 131 with the widened portions 133 of the top wall opening 139 determine whether and when the shackle 120 can be raised or depressed relative to the housing 110. In the locked position of the shackle 120 shown in FIG. 3, it will be seen that the projections 131 have moved into the widened portions 133 of the top wall opening 139 when the shackle 120 was depressed to its locked position (i.e., a position wherein the bottom end region 125 of the shorter leg 124 of the shackle 120 is seated within the recess 137 formed in the top wall 113 of the housing 110). When the shackle 120 moves from the locked position shown in FIG. 3 to the unlocked position shown in FIG. 7, it will be seen that the projections 131 move back out of the widened regions 133 of the top wall opening 139 to a position above the top wall 113—which permits the shackle 120 to be pivoted about the axis of the longer leg 126.

When the shackle 120 has been pivoted to the half-turn position illustrated in FIG. 15, it will be seen that the projections 131 again align with the widened regions 133 of the top wall opening 139, which means that the shackle 120 can be depressed to a position illustrated in FIG. 16 wherein the projections 131 have moved completely through the top wall opening 139 and into a space located just beneath the top wall 113—a space wherein the projections 131 do not inhibit turning of the shackle 120, hence the shackle 120 can again be pivoted about the axis of the longer leg 126, for example to the quarter turn position illustrated in FIG. 17. As will be explained in greater detail shortly, the half-turn, shackle depressed position illustrated in FIG. 16 is what is required to reset the indicator 300 from displaying its second state surface 302 (typically of the color "red") to displaying through the indicator window 250 the first state surface 301 (typically of the color "green"). And, as will be explained in greater detail shortly, the quarter-turn, shackle depressed position illustrated in FIG. 17 is an appropriately safe position for the shackle 120 to assume when the combination of the padlock 100 is to be reset.

Referring to FIG. 12, the cylinder 280 has a hollow left end region that surrounds the spirally grooved surface 275 of the slide 270, and has a hollow right end region that defines a suitably configured formation or formations, indicated generally by the numeral 285, configured to be drivingly engaged by the left end region 176 of the key 175 (after the left end region 176 of the key 175 has been inserted through the keyhole 350 of the housing 110) so that the key 175 can be turned to effect a corresponding, concurrent turning movement of the cylinder 280 to move the ball 190 around the spiral groove 275 of the slide 270 to move the slide 270 rightwardly, away from the normal position of the slide 270 wherein the fingers 272, 274, 276 of the slide 270 overlie some of the tooth formations 177 of the externally toothed sleeves 172, 172, 174. When the slide 270 is moved rightwardly from its normal position wherein its fingers 272, 274, 276 overlie some of the teeth 177 (as depicted in FIGS. 4–10) to a key-unlocked position (as depicted in FIGS. 11–14), the fingers 272, 274, 276 no longer overlie any of the teeth 177 and therefore no longer obstruct upward unlocking movement of the shackle 120 (which causes the toothed sleeves 172, 174, 176 to move upwardly with the shackle 120) when the shackle 120 is popped up to the unlocked position of FIG. 11 under the influence of the spring 145 which acts on the flat lower end region 135 of the longer leg 126 of the shackle 120.

The series of movements described just above (which is initiated by inserting and turning the key 175 in the housing 110 to cause the cylinder 280 to rotate to rightwardly move the slide 270 so that the fingers 272, 274, 276 no longer overlie the teeth 177 hence the shackle 120 is caused to pop up to the unlocked position under the influence of the spring 145) describes how the padlock 100 is unlocked by using the key 175. A reverse procedure is followed to relock the shackle 120 after the lock 100 has been opened by the key 175. To carry out the relocking of the lock 100 after the lock 100 has been opened by the key 175, the shackle 120 is depressed while the key 175 still is in the turned position (i.e., while the key 175 still is inserted into the keyhole 350 and still is turned as is required to cause the slide 270 to move rightwardly so that the fingers 272, 274, 276 no longer obstruct downward or upward movement of the longer leg 126 of the shackle 120 which carries the toothed sleeves 172, 174, 176) to bring the shackle to the locked position wherein the bottom end region 125 of the shorter leg 124 of the shackle 120 is seated in the top wall recess 137. The key 175 is then reverse-turned to move the slide 270 leftwardly to the normal position of the slide 270 wherein the fingers 272, 274, 276 overlie some of the teeth 177 of the toothed sleeves 172, 174, 176, and the key 175 then is removed from the keyhole 350.

Because the steel ball 290 establishes a one-way driving connection between the cylinder 280 and the slide 270 (that permits rotation of the cylinder 280 by the key 175 to move the slide 270 leftwardly and rightwardly within the confines of the housing 110, but does not permit the slide 270 to move leftwardly or rightwardly on its own so as to rotate the cylinder 280), the cylinder 280 does not rotate out of the position it normally occupies (wherein its formation 285 is ready to be drivingly engaged by the key's end region 176 anytime the end region 176 is inserted through the keyhole 350), and the slide 270 does not move rightwardly out of its normal position wherein its fingers 272, 274, 276 overlie some of the teeth 177 so as to obstruct the upward movement of the shackle 120, thus the lock 100 remains locked until either a correct combination is entered on the dials 202, 204, 206, or the key 175 is inserted and turned so as to rotate the cylinder 280 to move the slide 270 rightwardly to unlock the shackle 120.

The indicator member 300 can pivot relative to the housing 110 to selectively expose either the first state surface 301 (that preferably is colored "green") or the second state surface 302 (that preferably is colored "red") to be viewed through the indicator window 250 of the housing 110. The torsion coil spring 303 is arranged to serve what is well known to those skilled in the art as an "over center" function, meaning that the spring 303 either biases the indicator 300 toward its first state position (typically displaying the color "green" through the indicator window or opening 250 defined by the housing 110) as shown in FIGS. 3, 4, 7 and 8, or toward its second state position (typically displaying the color "red" through the indicator window or opening 250) as shown in FIGS. 11 and 12.

Figure 7:
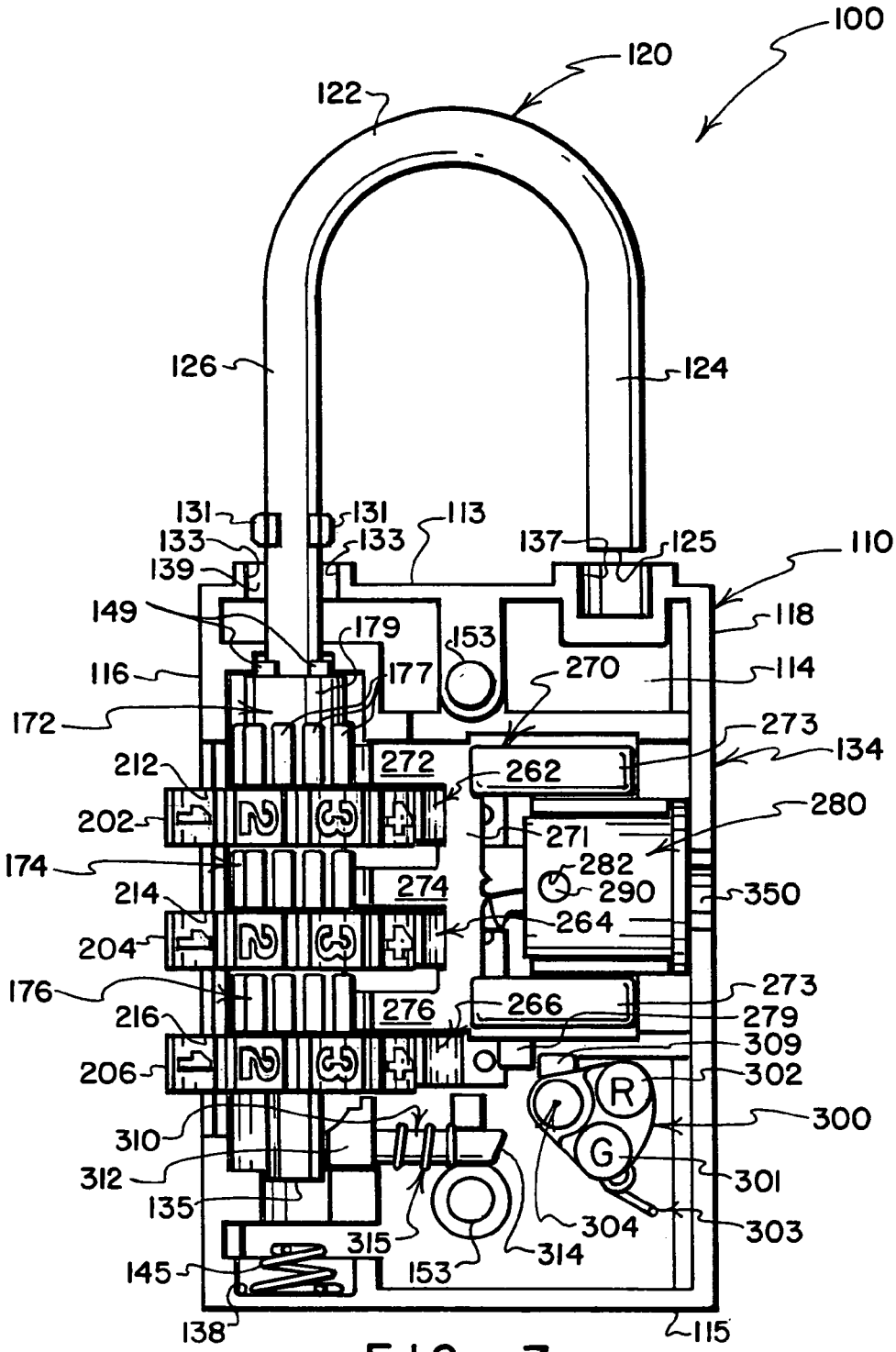
FIG. 7 is a front elevational view showing selected components of the padlock with the front shell of the housing removed, with the shackle unlocked as the result of entering a correct combination using the three dials of the padlock, and with the indicator still positioned to display a first state, namely the color green.
Figure 11:
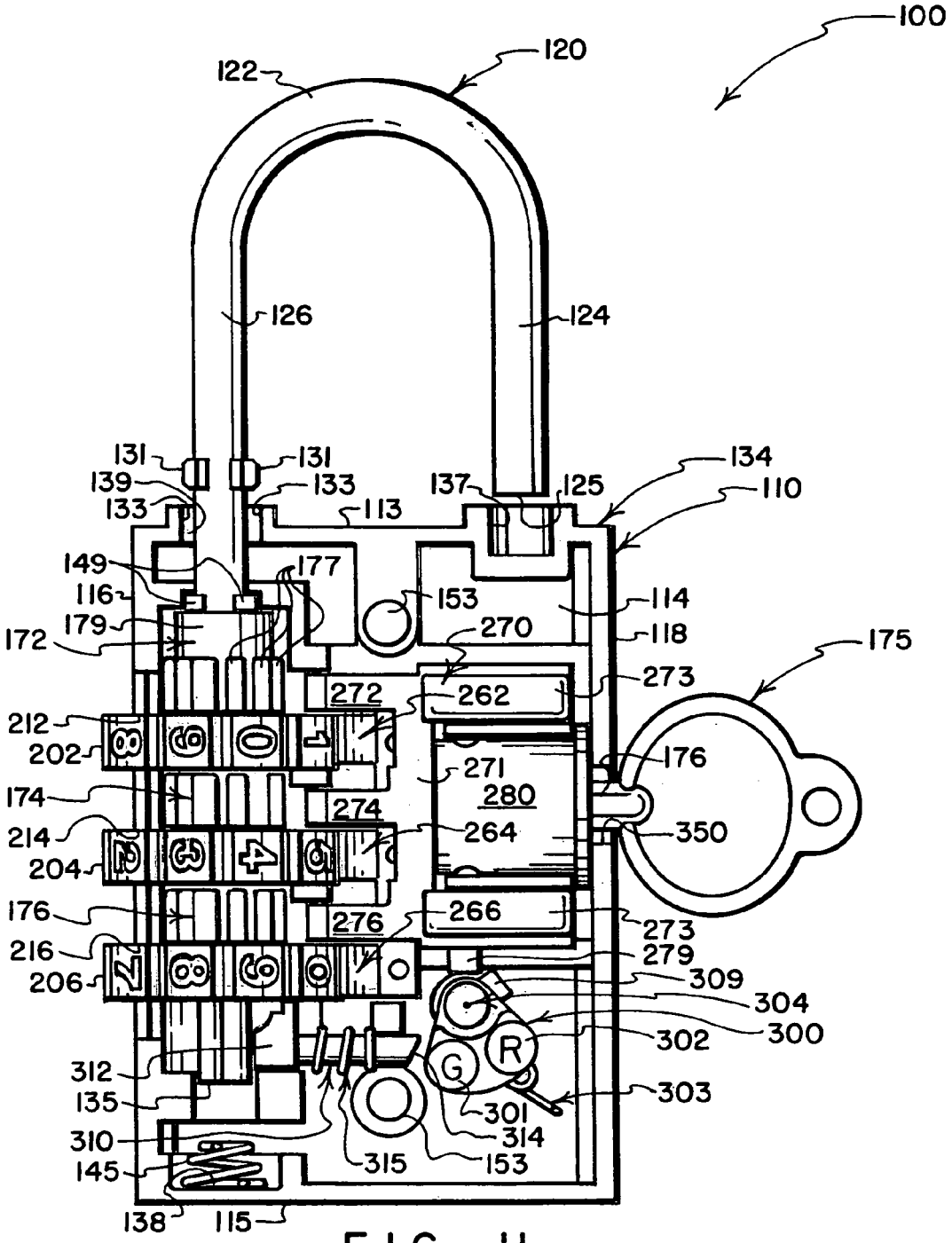
FIG. 11 is a front elevational view showing selected components of the padlock with the front shell of the housing removed, with the shackle unlocked as the result of inserting the key into the keyhole of the housing and turning the inserted key, and with the indicator moved (as the result of the key being turned) to display a second state, namely the color red.
Figure 13:
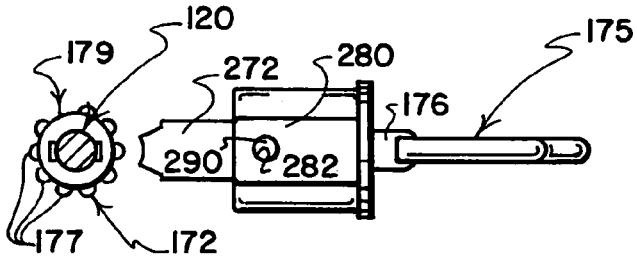
FIG. 13 is a sectional view as seen from a plane indicated by a line 13—13 in FIG. 12.
Figure 14:
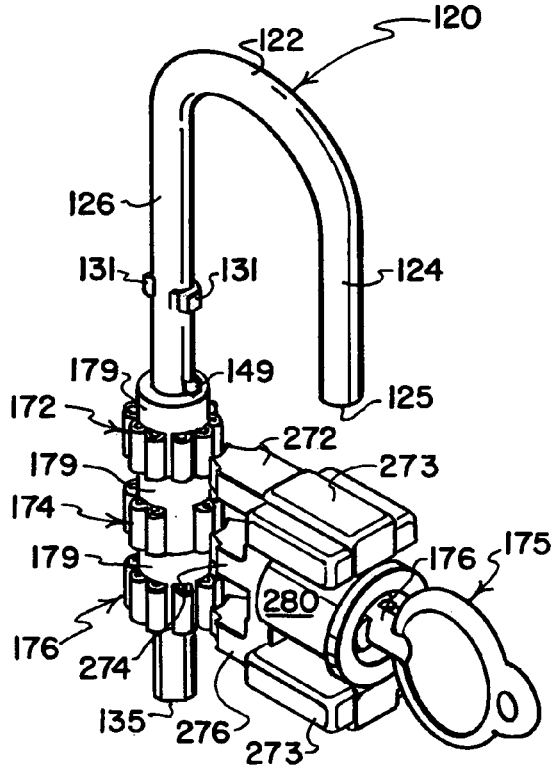
FIG. 14 is a perspective view of selected components of the padlock positioned as in FIGS. 11–13.
Figure 12:
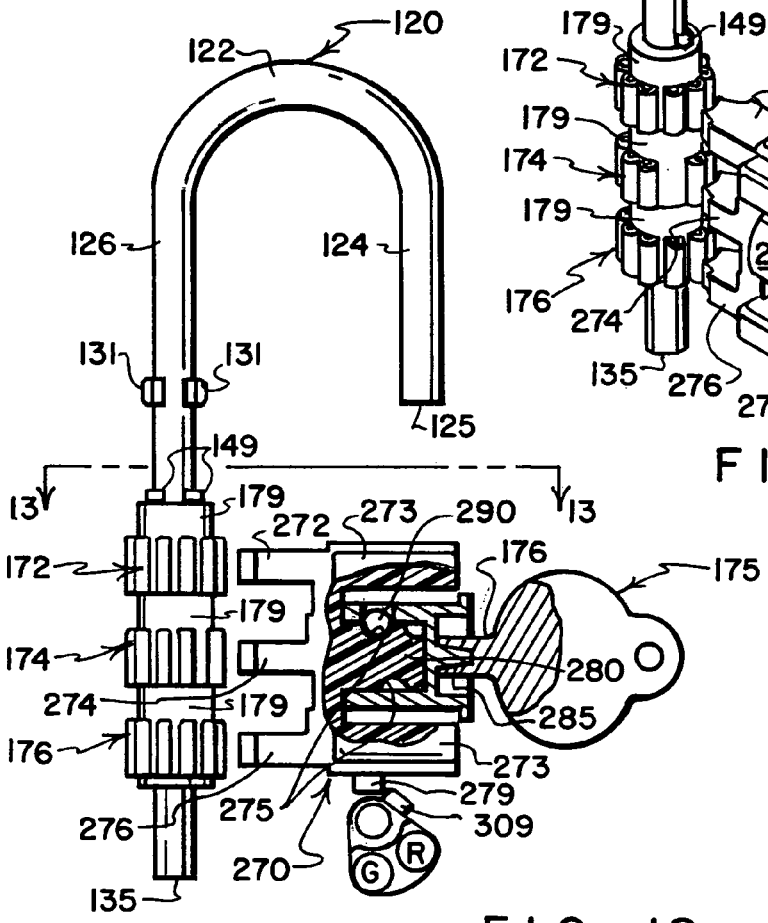
FIG. 12 is a front elevational view showing selected components of the padlock positioned as in FIG. 11, with portions of selected components broken away and shown in cross-section.

The indicator member 300 is caused to pivot from its normal state one position, depicted in FIGS. 3, 4, 7 and 8, to its state two position, depicted in FIGS. 11 and 12, by a depending tab 279 of the slide 270 which engages an upwardly projecting tab 309 of the indicator member 300. In FIGS. 3 and 7 it will be seen that the tabs 279, 309 will engage if the slide 270 is moved rightwardly if caused to do so by inserting and turning the key 175 so as to rotate the cylinder 280. In FIGS. 11 and 12 it will be seen that engagement of the tabs 279, 309 has caused the indicator member 300 to pivot about the axis 304 as the slide 270 has been moved rightwardly as the result of the key 175 being inserted and turned.

To reset the indicator member 300 from the second state position shown in FIGS. 11 and 12 to the normal first state position shown in FIGS. 3, 4, 7 and 8, the reset member 310 has a bar-shaped portion 312 with an enlarged head formation 312 at the left end of the bar-shaped portion 312, and with the head formation 312 being configured to be engaged when the shackle 120 is depressed after being half-turned (see FIGS. 15 and 16 which shows the shackle 120 before and after being depressed while in the half-turned position), which engagement causes the reset member 310 to be slided rightwardly along the axis of the bar-shaped portion 312 so that a right end region 314 of the bar-shaped portion 312 engages and pivots the indicator member 300 from the second state position depicted in FIGS. 11 and 12 to the first state position depicted in FIGS. 3, 4, 7 and 8. Depression of the shackle 120 as in FIG. 16 brings into engagement with a leftwardly facing cam surface of the enlarged head formation 312 of the reset member 310 one or more of 1) lower end portions of the shackle leg 126, 2) lower portions of the washer-like retaining clip 147, or 3) lower portions of the toothed sleeve 176—which engagement causes the indicator reset member 310 to move rightwardly in opposition to the action of the compression coil spring 315 which is interposed between the housing 110 and the enlarged head formation 312 of the reset member 310 so as to bias the reset member 310 leftwardly.

The reason why the indicator member 300 cannot be reset after the lock 100 has been opened utilizing the key 175 is because: 1) the slide 270 must be moved to the right (by keeping the turned key 175 in place in the lock housing 110) so that its fingers 272, 274, 276 will not obstruct the downward movement of the shackle 120 that is needed to cause the reset member 310 to move rightwardly to reset the indicator 300; and 2) if the slide 270 is moved to the right (as by keeping the turned key 175 in place in the lock housing 110) to permit downward movement of the shackle 120 to effect rightward movement of the reset member 310 to reset the indicator 300, the engagement of the tab 279 on the slide 270 with the tab 309 on the indicator 300 will retain the indicator 300 in its second state position thereby preventing rightward movement of the reset member 310 as the result of downward movement of the shackle 120—thus the indicator 300 cannot be reset while the key 175 remains turned in the lock 100, and the shackle 120 cannot be depressed to reset the indicator 300 after the lock 100 has been opened with the key 175 unless the slide 170 is moved rightwardly by the inserted and turned key 175. The only way the indicator 300 can be reset is by opening the lock 100 by using a correct combination so that, when the slide 120 is depressed to move the reset member 310 rightwardly, none of the downwardly moving teeth 177 of the sleeves 172, 174, 176 (that move downwardly with the shackle 120) will have their downward movement obstructed by the fingers 272, 274, 276 of the slide 270 that must be in its leftward position, otherwise the indicator 300 cannot be reset because the tabs 279, 309 of the slide 270 and the indicator 300 will engage to hold the indicator 300 in the second state position, preventing the resetting of the indicator 300 to the first state position.

In operation, starting with the shackle 120 of the padlock 100 in its closed or locked position as depicted in FIGS. 1 and 3, and starting with the indicator 300 displaying through the indicator window 250 the first state surface 310 (typically of the color "green"), the padlock 100 can be unlocked either by entering a predetermined combination (known to the owner of the lock 100) using the dials 202, 204, 206, or by inserting the key 175 into the keyhole 350 and turning the key 175.

Figure 10:
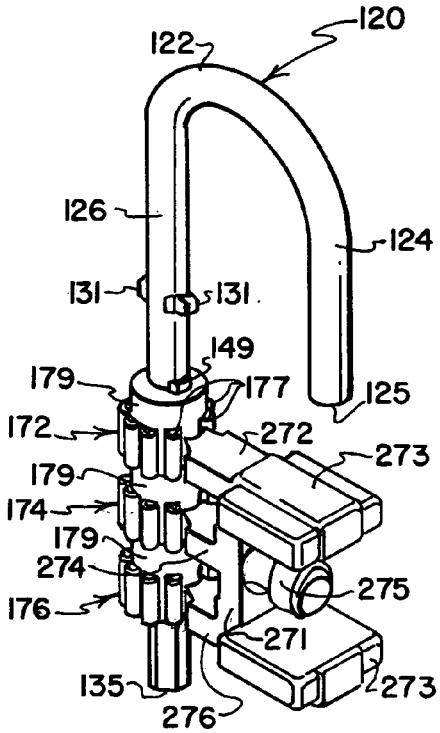
FIG. 10 is a perspective view of selected components of the padlock positioned as in FIGS. 7–9.
Figure 8:
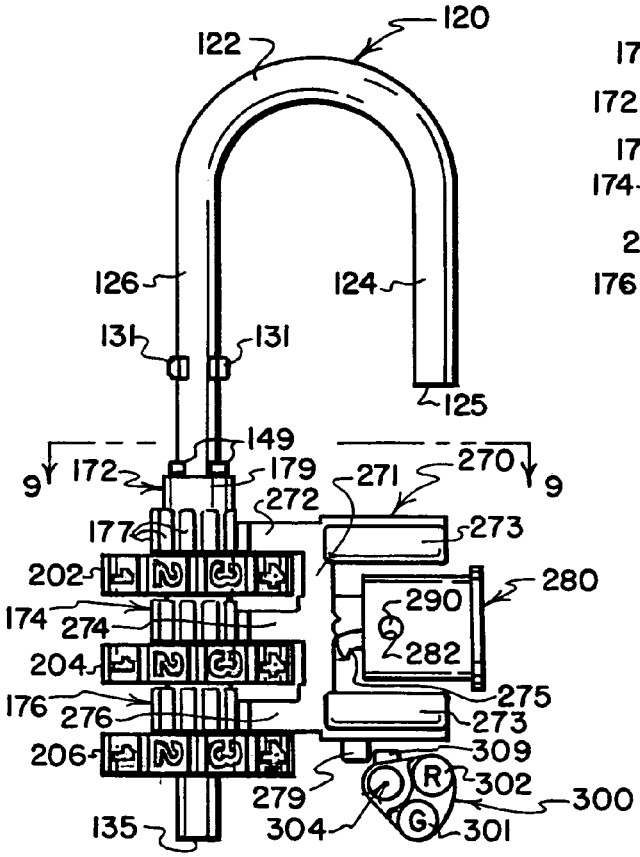
FIG. 8 is a front elevational view showing selected components of the padlock positioned as in FIG. 7.

Opening the padlock 100 by entering the combination involves nothing more than dialing in the combination using the dials 202, 204, 206—so that, when the correct numbers of the combination are aligned with an appropriate portion of the housing 110, the toothless or open-toothed positions of the externally toothed sleeves 172, 174, 176 are aligned with the fingers 272, 274, 276 of the slide 270—which permits the spring 145 to pop up the shackle 120 to the unlocked position of FIG. 7. The alignment of the toothless or open-toothed positions of the sleeves 172, 174, 176 with the fingers 272, 274, 276 is depicted in FIGS. 8–10 which also show that the shackle 120 has popped up relative to the dials 202, 204, 206 (which do not move vertically relative to the housing because the dials 202, 204, 206 are retained in slots 212, 214, 216 of the housing 110).

Once the shackle 120 of the padlock 100 has been opened as by entering a correct combination in the manner just described, any one of three actions can be taken. First, and most obviously, the shackle 120 can be relocked as by depressing the shackle 120 and rotating the dials 202, 204, 206 so that the fingers 272, 274, 276 no longer align with the toothless or open-toothed positions of the toothed sleeves 172, 174, 176. The lock 100 stays locked because the fingers 272, 274, 276 overlie at least some of the teeth 177 of the sleeves 172, 174, 176 which prevents the sleeves 172, 174, 176 (and hence the shackle 120 on which the sleeves 172, 174, 176 are mounted) from moving upwardly to an unlocked position.

A second action that can be taken when the shackle 120 has been opened by entering a correct combination using the dials 202, 204, 206, is to reset the indicator 300 (if the indicator 300 has been moved to its second state position displaying through the window 250 the second state surface 302, typically the color "red"). To reset the indicator 300, the shackle 120 is turned to the half-turned position of FIG. 15 and is depressed as shown in FIG. 16 to cause the reset member 310 to move rightwardly as has been described above to engage and pivot the indicator 300 from its second state position back to its normal first state position wherein the first state surface 301 is displayed through the window 250 (typically the color "green"). Once the indicator 300 has been reset, the shackle 120 is raised and then rotated back so the shorter leg 124 has its lower end region 125 aligned with the housing recess 137 so that the shackle 120 then can be depressed to lock the lock 100.

A third action that can be taken when the shackle 120 has been opened by entering a correct combination using the dials 202, 204, 206, is to reset the combination that is to be employed to open the lock 100 the next time the lock 100 is locked. To do this, the shackle 120 is pivoted to the half-turned position shown in FIG. 15, the shackle 120 is depressed to the position shown in FIG. 16 (which also accomplishes the second action described just above of resetting the indicator 300 if the indicator 300 was displaying the second state surface 302 when the shackle 120 was depressed to the position shown in FIG. 16), and then turning the depressed shackle 120 to the quarter-turned position depicted in FIG. 17.

When the depressed shackle 120 is turned a quarter turn from the depressed shackle position shown in FIG. 16 to the depressed shackle position shown in FIG. 17, it is safe to turn the dials 202, 204, 206 to line up a new combination for operating the padlock 100 the next time that the lock 100 is locked. Actually, the dials 202, 204, 206 could be turned to set a new combination while the shackle 120 is depressed to the position shown in FIG. 16; however, this is a relatively unsafe thing to do for, if the shackle 120 should pop up (under the influence of the spring 145 that acts on the flat bottom end region 135 of the longer leg 126 of the shackle 120), the dials 202, 204, 206 might be caused to set a combination that is unknown to the owner of the lock—a combination that might need to be discovered by endlessly turning the dials 202, 204, 206 while trying many or all of the set of combinations that includes every possible combination that can be set on the lock 100.

What permits the combination to be reset when the shackle 120 is depressed as shown in FIGS. 16 and 17 is that the teeth 177 are disengaged from the teeth 187 during such depression of the shackle 120, which means that the dials 202, 204, 206 may be turned freely without causing corresponding turning of the sleeves 172, 174, 176— thus, while the sleeves 172, 174, 176 are held in their unlocking positions (with the fingers 272, 274, 276 extending into the toothless positions of the sleeves 172, 174, 176 so that the sleeves 172, 174, 176 can not be moved out of their unlocking positions), the dials 202, 204, 206 are reoriented to reflect a combination that will operate the lock when the internal teeth 187 of the dials 202, 204, 206 are brought back into engagement with the external teeth 177 of the sleeves 172, 174, 176.

What renders the quarter-turn shackle position shown in FIG. 17 safer for resetting the combination of the lock 100 than the half-turned position shown in FIG. 17 is that, when the shackle 120 is in the quarter-turned position of FIG. 17, the projections 131 on the longer leg 126 of the shackle 120 underlie the top wall 113 of the padlock's housing 110 to prevent the shackle 120 from accidentally popping up under the influence of the spring 145 which biases the longer leg 126 upwardly relative to the housing 110. If the dials 202, 204, 206 are moved relative to the sleeves 172, 174, 176 while the shackle 120 is being manually depressed as shown in FIG. 16, the person holding the shackle 120 manually depressed in opposition to the action of the spring 145 runs the risk of letting the shackle 120 slip (or of weakening his grip on the depressed shackle 120 enough that the shackle 120 is no longer held in the fully depressed position illustrated in FIG. 16) which may cause some of the teeth 177, 187 to engage, resulting in an unwanted and unknown combination being set.

As will be apparent from the foregoing, the present invention brings to combination and key operated luggage locks a clever, resettable indicator arrangement that is quite unlike other padlock indicator proposals, and that serves a need that is not met by other padlock proposals—namely a need to advise the owner of padlocked luggage that his bag or bags may have been inspected by someone who has opened the padlocks thereon using a key. If government personnel continue to insert a leaflet into inspected bags that also advises the owners of luggage that certain of their bags have been inspected, the absence of such a leaflet in a bag that is locked by a padlock having an indicator that is displaying a second state (such as the color "red") will let the owner of the bag know that someone other than government personnel have opened the bag for pilfer or theft utilizing a key that was intended to be provided only to government inspectors.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty that exist in the invention disclosed.

The invention claimed is:

1. A padlock having both a combination mechanism that can open the padlock and a key mechanism that can open the padlock, and having an indicator for indicating at least at a time after the padlock has been relocked whether the padlock was opened by the key mechanism wherein the indicator includes an indicator member that moves from a first position displaying to view a normal first state to a second position displaying to view a second state as the result of the padlock being opened by the key mechanism.

2. The padlock of claim 1 wherein the indicator displays the first state and the second state to view through a window of the padlock.

3. The padlock of claim 1 wherein the indicator is resettable from displaying the second state to displaying the first state only after the padlock is opened by the combination mechanism.

4. The padlock of claim 1 additionally including a housing and a shackle that is movable relative to the housing between a locked position and an unlocked position when the padlock is opened by using a key to operate the key mechanism or by setting a combination to operate the combination mechanism, wherein the indicator member is connected to the housing for movement between the first and second positions and is capable of displaying a first surface that is viewable through a window of the housing when the indicator member is in the first position, and of displaying a second surface through the window when in the second position, with the first and second surfaces differing in appearance one from the other.

5. The padlock of claim 4 wherein the first and second surfaces are of different colors.

6. The padlock of claim 4 wherein the first surface displays the color green, and the second surface displays the color red.

7. The padlock of claim 4 wherein the shackle also is movable relative to the housing to an indicator reset position after the shackle has been opened by setting said combination, and wherein the indicator is resettable from displaying the second surface to displaying the first surface only by opening the shackle by setting said combination, and by moving the shackle to the indicator reset position.

8. The padlock of claim 7 wherein the shackle also is movable relative to the housing to a combination reset position after the shackle has been opened by setting said combination, and wherein the combination that is set to open the padlock can be reset from a first combination to a second combination by opening the shackle by setting the first combination, and by moving the opened shackle relative to the housing to the combination reset position.

9. The padlock of claim 4 additionally including means for biasing the indicator member toward at least a selected one of the first and second positions.

10. The padlock of claim 4 wherein an indicator reset member is movably supported within the interior of the housing for movement between a normal position of the reset member and reset position of the reset member, and the indicator reset member is adapted to be moved from the normal position of the reset member to the reset position of the reset member for resetting the indicator member from the second position to the first position in response to the shackle being depressed into the housing.

11. A padlock having a combination mechanism and a key mechanism carried by a housing, and having a shackle movable relative to the housing between a locked position and an unlocked position wherein the shackle can be opened for movement from the locked position to the unlocked position by operating either mechanism, and having an indicator capable of displaying a normal first color until the indicator is switched to displaying a second color only as the result of the shackle being released by the key mechanism for movement from the locked position to the unlocked position, with a display of the second color being maintained by the indicator at a time after the shackle of the padlock was returned to the locked position after being released by operation of the key mechanism.

12. The padlock of claim 11 wherein the indicator is resettable from displaying the second color to displaying the first color only if the shackle is opened by setting a combination to operate the combination mechanism.

13. The padlock of claim 12 wherein the shackle also is movable relative to the housing to an indicator reset position after the shackle has been opened by setting said combination, and wherein the indicator is resettable from displaying the second color to displaying the first color only by opening the shackle by setting said combination and by moving the shackle to the indicator reset position.

14. The padlock of claim 13 wherein the shackle also is movable relative to the housing to a combination reset position after the shackle has been opened by setting said combination, and wherein the combination that is set to open the padlock can be reset from a first combination to a second combination by opening the shackle by setting the first combination, and by moving the opened shackle relative to the housing to the combination reset position.

15. The padlock of claim 11 wherein the housing has an interior region and has a window that opens through a wall of the housing into the interior region, wherein the indicator includes an indicator member supported in the interior region for movement between a first color position and a second color position, with a first surface of the indicator member being displayed in the window of the housing when the indicator is in the first color position so as to display said first color, and with a second surface of the indicator member being displayed in the window of the housing when the indicator is in the second color position so as to display said second color.

16. The padlock of claim 11 wherein said first color is green and wherein said second color is red.

17. The padlock of claim 15 additionally including means for biasing the indicator member toward at least a selected one of said first color position and said second color position.

18. The padlock of claim 17 wherein the indicator member is supported by the housing for pivotal movement through an arc of travel between the first color position and the second color position, and wherein the means for biasing the indicator member functions to bias the indicator member toward the first color position when the indicator member has moved along the arc of travel so as to be located nearer to the first color position than to the second color position, and to bias the indicator member toward the second color position when the indicator member has moved along the arc of travel so as to be located nearer to the second color position than to the first color position.

19. The padlock of claim 15 wherein the shackle has a leg that extends through an interior portion of the housing, wherein the padlock additionally includes a plurality of indicia bearing dials that are connected to said leg within said interior portion of the housing, with said dials projecting through at least one opening defined by the housing so that exterior surface portions of the dials can be accessed for rotating the dials to set a combination to operate the combination mechanism to open the padlock.

20. The padlock of claim 19 wherein said leg of the shackle extends along an imaginary axis about which the dials may be rotated to set said combination, and said leg of the shackle can be depressed into the housing as by moving said leg axially along said axis to cause the indicator member to move from the second color position to the first color position to reset the indicator in response to said axial movement.

21. The padlock of claim 20 wherein said leg of the shackle carries means for cooperating with at least one formation of the housing to permit said leg of the shackle from being depressed into the housing and moved along said axis to cause the indicator member to be reset only when the shackle is rotated about said axis relative to said housing to a reset position of the shackle.

22. The padlock of claim 20 wherein an indicator reset member is movably supported within the interior of the housing for movement between a normal position of the reset member and reset position of the reset member, and the indicator reset member is adapted to be moved from the normal position of the reset member to the reset position of the reset member for resetting the indicator from the second color position to the first color position in response to the shackle being depressed into the housing and moved along said axis.

23. The padlock of claim 22 additionally including means for biasing the indicator reset member toward the normal position of the reset member and for opposing movement of the reset member from the normal position of the reset member toward the reset position of the reset member.

24. The padlock of claim 23 wherein the reset member is configured to be engaged by a slide member that is connected to the housing for movement within the interior of the housing between a normal position of the slide member and a key unlocked position of the slide member, wherein the housing defines a keyhole for receiving said key which is configured to be inserted through the keyhole and turned to open the padlock, wherein a cylinder member 1) is supported for rotation by the housing within the interior of the housing at a location adjacent the keyhole, 2) is configured to be engaged by and rotated by the key when the key is inserted through the keyhole and turned, 3) is configured to move the slide member from the normal position of the slide member wherein the slide prevents the shackle from being opened except when a correct combination is set to open the padlock to the key unlocked position of the slide member wherein the slide member permits the shackle to be opened without setting a correct combination to open the padlock, and 4) is configured to engage the indicator member so as to move the indicator member from the first color position to the second color position as the slide member is moved from the normal position of the slide member to the key unlocked position of the slide member.

25. The padlock of claim 24 wherein a one-way driving connection is provided between the cylinder member and the slide member that permits rotation of the cylinder member by the key to move the slide member between the normal position of the slide member and the key unlocked position of the slide member, but does not permit movement of the slide member between the normal position of the slide member and the key unlocked position of the slide member to cause rotation of the cylinder.

26. The padlock of claim 25 wherein the one-way driving connection includes a spiral groove formed on a portion of the slide member that extends into a tubular portion of the cylinder member along an imaginary axis about which the cylinder member rotates relative to the housing when the key is inserted through the keyhole and turned, and includes a steel ball that is carried in a hole formed through a wall of the tubular portion of the cylinder member, with the ball extending into the spiral groove to drivingly connect the slide member to the cylinder so the slide member will move between the normal position of the slide member and the key unlocked position of the slide member in response to insertion and turning of the key.

27. A padlock having a housing and a shackle that is movable relative to the housing between a locked position and an unlocked position, a locking mechanism for retaining the shackle in the locked position, a combination mechanism including dial means for causing the locking mechanism to release the shackle for movement from the locked position to the unlocked position in response to entry of a predetermined combination, key mechanism including key responsive means for causing the locking mechanism to release the shackle for movement from the locked position to the unlocked position in response to insertion and turning of a correctly configured key, and an indicator connected to the key responsive means for indicating by a change of color, at least at a time after the shackle was relocked after being released by insertion and turning of said key, that the shackle was released for movement from the locked position to the unlocked position in response to insertion and turning of said key.

28. The padlock of claim 27 wherein the housing defines an aperture, and wherein the indicator is visible through the aperture to indicate if the shackle has been released for movement from the locked position to the unlocked position in response to said insertion and turning of said key.

29. The padlock of claim 28 wherein the indicator provides a first color surface that is viewable through the aperture when the indicator is in a first position, and a second color surface that is viewable through the aperture when the indicator is in a second position, with the first color surface being viewable through the aperture when the shackle has been released for movement from the locked position to the unlocked position in response to said entry of said predetermined combination, and with the second color surface being viewable through the aperture when the shackle has not been released for movement from the locked position to the unlocked position in response to said insertion and turning of said key.

30. The padlock of claim 29 wherein the first color surface is green and second color surface is red.

31. The padlock of claim 27 additionally including means for resetting the indicator after the shackle has been released for movement from the locked position to the unlocked position in response to said entry of said predetermined combination.

32. The padlock of claim 31 wherein the means for resetting the indicator is configured to cause the indicator to be reset in response to depressing the shackle into the housing after the shackle has been released for movement from the locked position to the unlocked position in response to said entry of said predetermined combination.

33. A padlock having both a combination mechanism and a key mechanism that can be opened by either mechanism, having a color indicator for indicating whether the padlock was opened by the key mechanism.

* * * * *

UNITED STATES PATENT AND TRADEMARK OFFICE

CERTIFICATE OF CORRECTION

PATENT NO. : 7,007,521 B1
DATED : March 7, 2006
INVENTOR(S) : Misner et al.

It is certified that error appears in the above-identified patent and that said Letters Patent is hereby corrected as shown below:

Column 1,
Line 64, delete “padlocks” and substitute -- padlock --.

Column 2,
Line 39, after “surface” insert -- of -- (2nd occurrence).
Line 60, after “after” insert -- the --.

Column 3,
Line 58, delete “9”.

Column 5,
Line 28, delete “as the” and substitute -- as to --.
Line 32, after “202” insert -- , 204, 206 --.

Column 6,
Line 18, delete “134” and substitute -- 132 --.

Column 10,
Line 18, delete “170” and substitute -- 270 --.
Line 21, delete “120” and substitute -- 270 --.
Line 35, delete “310” and substitute -- 301 --.

Signed and Sealed this

Sixteenth Day of May, 2006

JON W. DUDAS
*Director of the United States Patent and Trademark Office*